US006896643B2

(12) United States Patent
Durfee, Jr.

(10) Patent No.: US 6,896,643 B2
(45) Date of Patent: May 24, 2005

(54) ABDOMINAL EXERCISE MACHINE

(75) Inventor: David L. Durfee, Jr., Meadville, PA (US)

(73) Assignee: New Eagle Corporation, Meadville, PA (US)

( * ) Notice: Subject to any disclaimer, the term of this patent is extended or adjusted under 35 U.S.C. 154(b) by 498 days.

(21) Appl. No.: 10/153,487

(22) Filed: May 21, 2002

(65) Prior Publication Data

US 2003/0220175 A1 Nov. 27, 2003

(51) Int. Cl.[7] ..... A63B 23/02
(52) U.S. Cl. ..... 482/100; 482/136; 482/140
(58) Field of Search ..... 482/92–94, 97–103, 482/133–138, 140, 142

(56) References Cited

U.S. PATENT DOCUMENTS 4,235,437 A * 11/1980 Ruis et al. ..... 482/5
4,456,245 A * 6/1984 Baldwin ..... 482/136
5,094,449 A * 3/1992 Stearns ..... 482/130
5,324,247 A * 6/1994 Lepley ..... 482/134
5,549,535 A * 8/1996 Wang et al. ..... 482/138
6,015,372 A * 1/2000 Steffee et al. ..... 482/137
6,022,303 A * 2/2000 Abdo ..... 482/140
6,113,522 A * 9/2000 Fontenot et al. ..... 482/111
6,248,047 B1 * 6/2001 Abdo ..... 482/130
6,602,171 B1 * 8/2003 Tsen et al. ..... 482/140
6,626,808 B1 * 9/2003 Adams ..... 482/140
6,776,743 B2 * 8/2004 Hur ..... 482/140

* cited by examiner

*Primary Examiner*—Danton D. DeMille
*Assistant Examiner*—Victor K. Hwang
(74) *Attorney, Agent, or Firm*—Richard K. Thomson

(57) ABSTRACT

The actuator for the exercise machine is mounted to the seat to pivot about a vertically extending axis to permit the user to rotate her/his upper torso and vary the muscle groups being exercised to enhance the beneficial effects. A rotational connection between a shoulder harness element and the actuator arm facilitates this side crunching motion. A second feature which may be used separately or in conjunction with the rotational actuator, is an actuator arm with both a shoulder socket and an elbow joint that pivot, the elbow joint requires additional force to break over. This dual-pivot actuator arm permits the user to perform abdominal crunches with a predetermined resistance.

9 Claims, 5 Drawing Sheets

ABDOMINAL EXERCISE MACHINE

BACKGROUND AND SUMMARY OF THE INVENTION

The present invention is directed to an abdominal exercise machine with several features improving the user's ability to exercise better: i) a pivot axle permitting the actuator arm to rotate about a vertical axis allows the user to exercise oblique muscles, ii) a rotational connection between the shoulder harness and the balance of the actuator arm to permit lateral crunches, and iii) the actuator arm has both a shoulder socket and an elbow joint, each of the pivotable joints requiring different forces permitting the user to perform abdominal crunches with a predetermined resistance.

The Nation's appetite for exercise equipment is virtually insatiable. Annual dollar expenditures for home exercise equipment is in the hundreds of millions in the US alone. Meanwhile, memberships to health clubs with access to commercial gym equipment continue to grow. This explains the large number of innovations in the area of exercise equipment. Still, none of the abdominal exercise machines offer the necessary range of motion to permit full ab development and toning.

The abdominal exercise machine of the present invention features several novel characteristics that enhance ab development and toning. The first is an abdominal exercise machine that features a resistance unit; a seat for supporting a user, the axis of the user's torso extending generally vertically upward from the seat in an at rest position; an actuation unit positioned adjacent to the seat and pivotally connected thereto so that the actuation unit may pivot about an axis of rotation immediately adjacent and generally parallel to the axis of the user's torso; a cable interconnecting the resistance unit to the actuation unit, the cable having a length extending along the axis of rotation to facilitate pivoting of the actuation unit relative to the seat; whereby the user can manipulate the actuation unit in a twisting motion to exercise muscle groups including oblique and transversalis muscles.

The second characteristic of the abdominal exercise equipment of the present invention which may be used separately or in conjunction with the first, is an actuator arm with a dual pivot point permitting a secondary pivoting action which permits an abdominal stomach crunching motion which provides superior abdominal development and toning.

A third feature of the present invention is a novel engagement arm on the actuator. Hand grips are provided to allow the user to lower the shoulder-engaging pads into operative position. The engagement arm is attached to the balance of the actuator arm by a connection which permits 30° rotational movement in either direction with respect to the actuator arm. This rotational capability enhances the ability of the exercise machine to provide a measured amount of resistance to additional muscle groups in the abdominal and oblique muscle areas.

A scaled down, lower cost second embodiment is provided that has most of the same benefits of the first embodiment but which may be manufactured and sold at a fraction of the cost of the first embodiment to enable the machine to be more competitive in the low-end equipment market.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
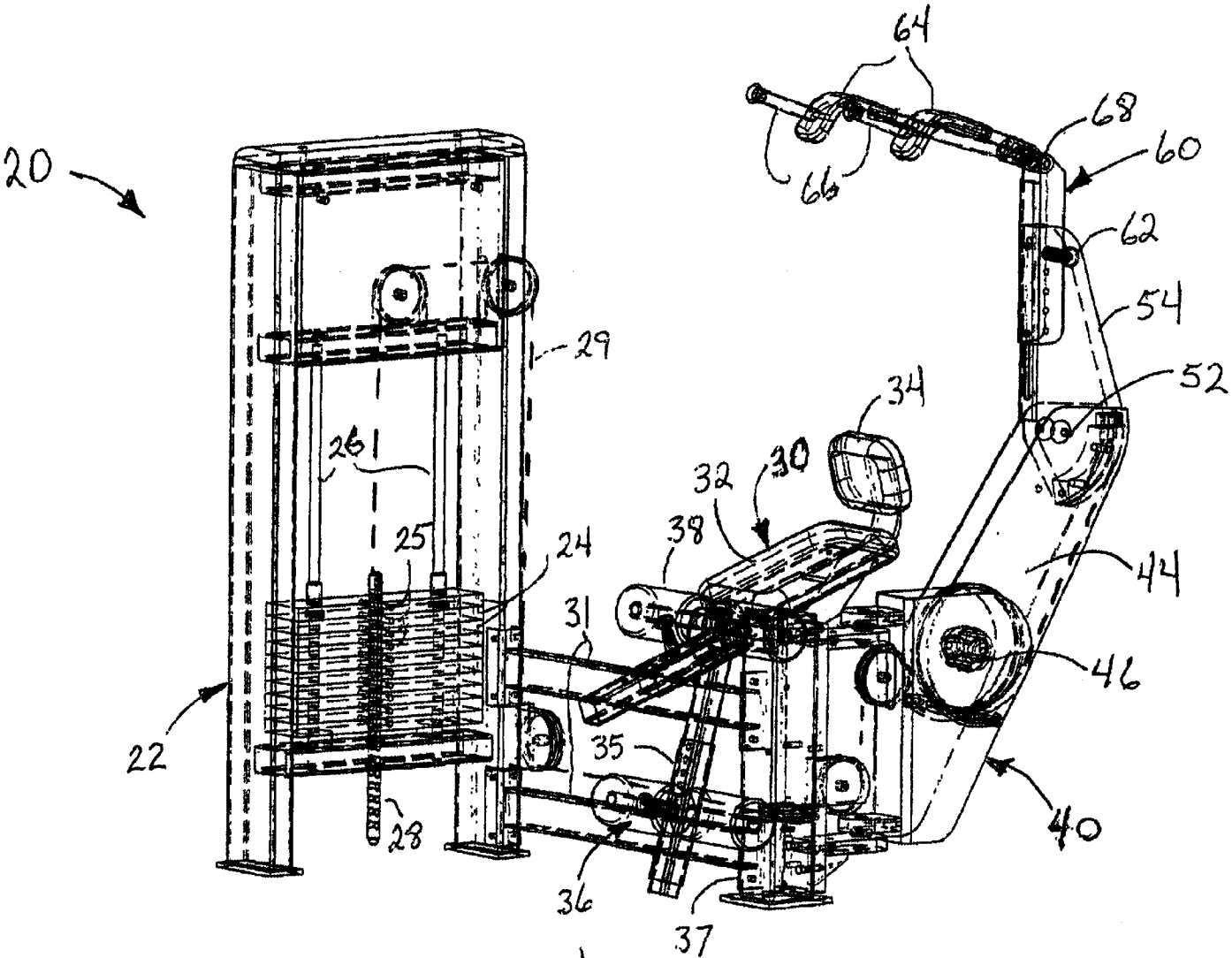
FIG. 1 is a perspective view of a first embodiment of the abdominal exercise machine of the present invention.

A first embodiment of the abdominal exercise machine of the present invention is depicted in FIGS. 1–4 generally at 20. Exercise machine 20 has three principle components: a resistance unit 22, a seat 30 for supporting the user in a generally vertical orientation, and an actuation unit 40 positioned adjacent the seat 30 and attached thereto. Resistance unit 22 is shown as a conventional weight stack in which a plurality of individual weights 24 are arranged to slide up and down on guide rods 26. A pin (not shown) is positioned through one of the holes 25 in the individual weights 24 and connector rod 28 to determine how many weights 24 (and, hence, how much resistance exerted to movement) are added to connector rod 28 and support cable 29. Although a conventional weight stack has been shown as a resistance unit 22, it will be appreciated that any form of adjustable resistance including magnetic or electrostatic fields, tension bands or friction elements could be substituted without departing from the essence of the invention.

Figure 2:
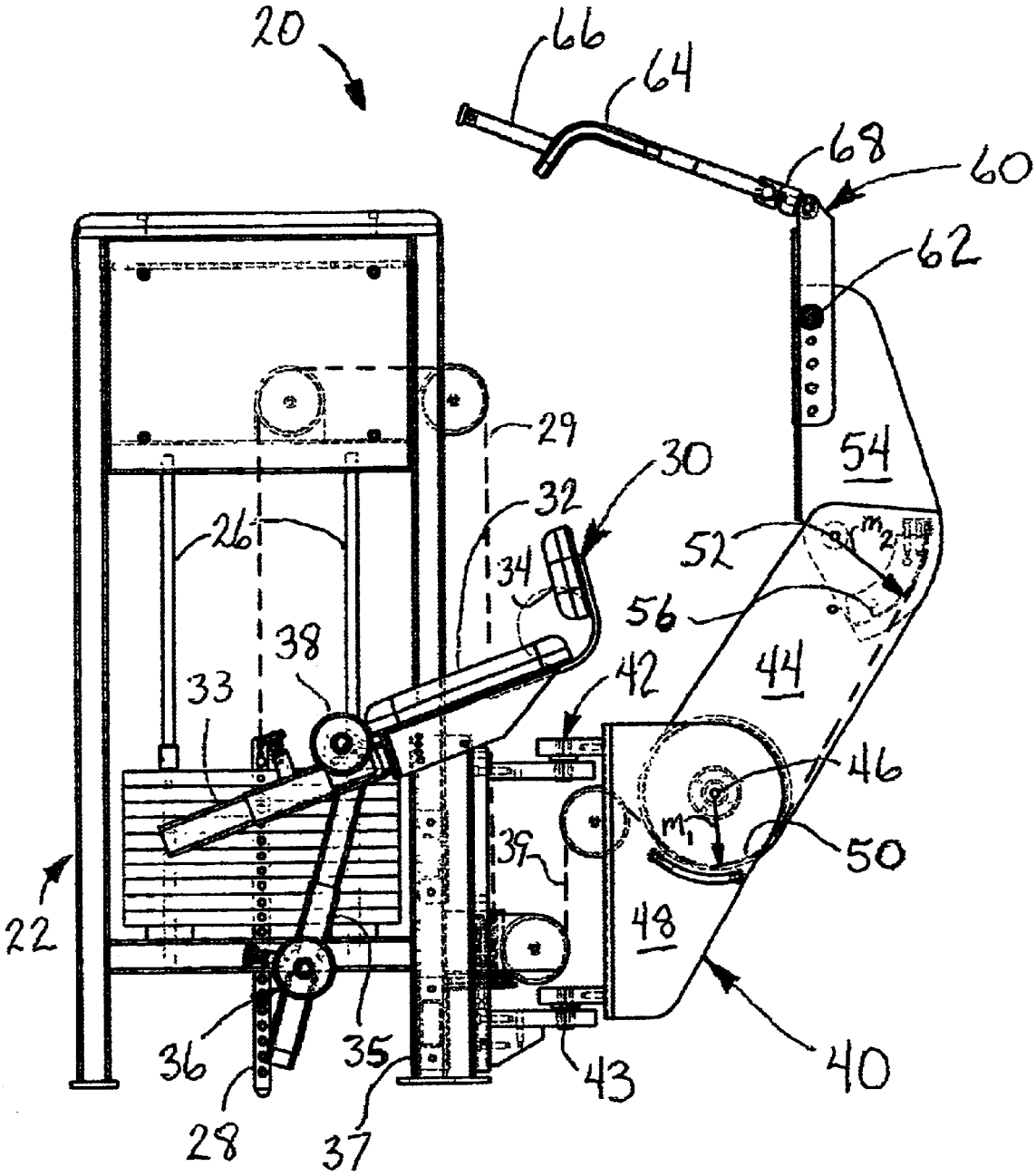
FIG. 2 is a side view of the first embodiment.
Figure 3:
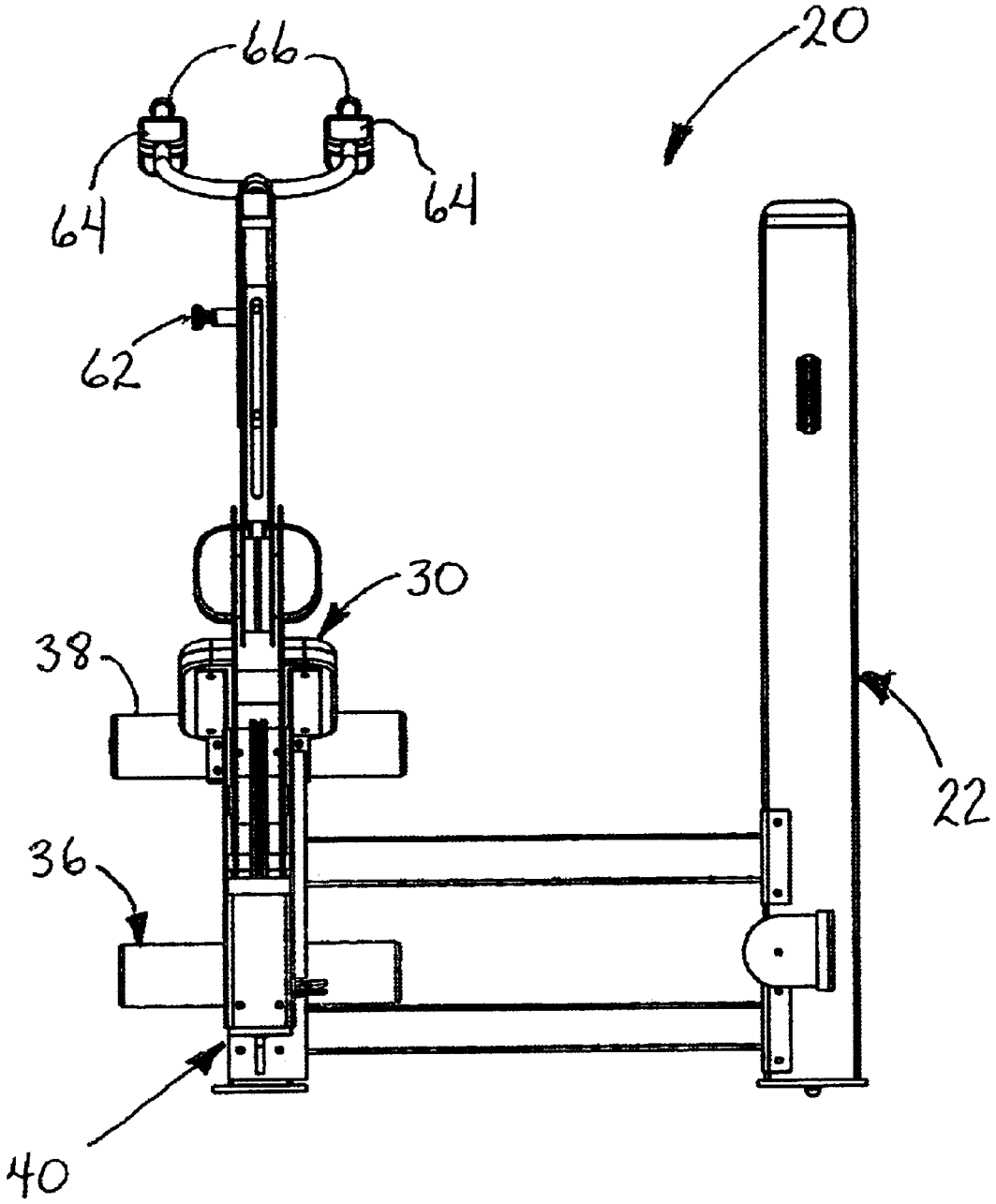
FIG. 3 is a back view of the first embodiment.
Figure 4:
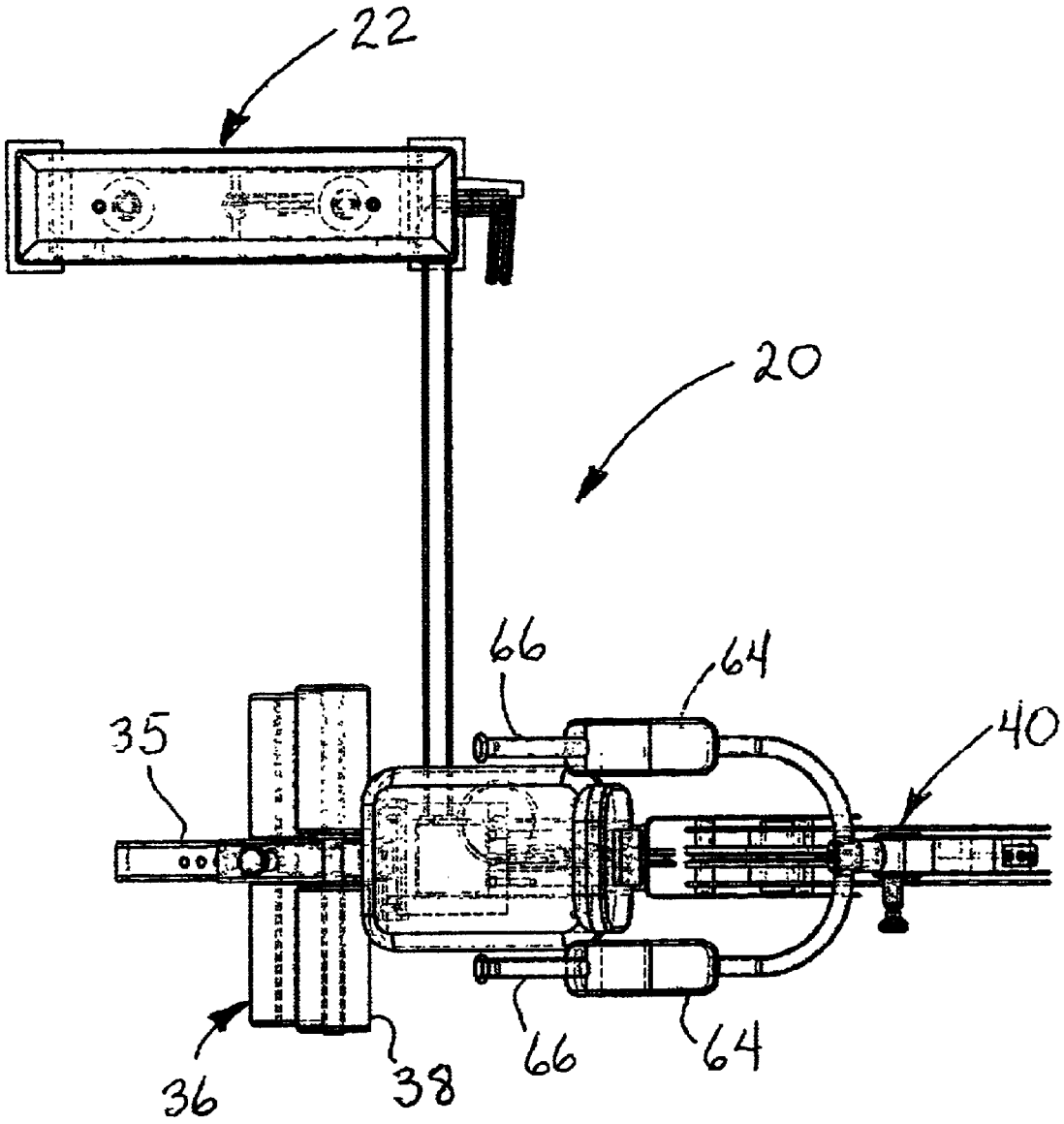
FIG. 4 is a top view of the first embodiment.

Seat 30 is interconnected to resistance unit 22 by beams 31. As best seen in FIG. 2, seat 30 includes a straddle pad 32 with an attached back rest 34 mounted above pedestal 37. Straddle pad 32 supports the user with the axis of the user's torso extending generally vertically upward from the seat pad 32 in an at rest position. An adjustable foot rest 36 extends downward and forward from its connection to the straddle bar 33. A sleeve 35 permits the foot rest 36 to be moved upward or downward to permit adjustment for different calf lengths. In addition, the position of leg rest 38 can be adjusted up and down straddle bar 33 to accommodate different thigh lengths.

Actuation unit 40 is positioned adjacent and pivotally mounted to seat 30. A pivot axle 42 is formed by a first upper bearing member 43 and a second lower bearing member 43. A length 39 of cable 29 extends vertically directly along the axis of pivot axle 42 to facilitate the pivotal movement of actuation unit 40 about an axis of rotation immediately adjacent to and generally parallel to the axis of the user's torso. This rotational movement of actuation unit 40 about a vertical axis permits a user to exercise additional muscle groups including oblique and transversalis muscles. The user can do crossover crunches to enhance the toning features of the abdominal exercise machine 20.

The actuation unit 40 has a first arm section 44 pivotally mounted about shoulder socket 46 to the base 48 of unit 40. A second arm section 54 is pivotally mounted to first arm section 44 about an elbow joint 52. Cable 29 engages a first cam 50 in shoulder socket 46 and a second cam 56 in elbow joint 52. A shoulder harness element 60 is adjustably mounted on an upper portion of second arm section 54. Locking pin 62 can be positioned in any one of a plurality of holes to permit the shoulder harness element 60 to extend generally horizontally in use and to fit snugly on the user's shoulders. A handle 66 extends from the front of each shoulder engaging pad 64 to enable the user to pull down on the shoulder harness element 60. The pivot connection 68 permits limited rotational movement (up to 30° in each direction) to permit one shoulder to dip relative to the other, consistent with the motion necessary to perform side crunches. The rotation is preferably limited to 30° to reduce the risk of injury to the user associated with contorting her/his body in unnatural postures. This structure enables the user to exercise his abdominal muscles rather than simply strengthening his hand gripping muscles. Most preferably, the moment arm $m_2$ of second cam 56 is longer than moment arm $m_1$ of first cam 50 so that initial movement by the user will cause the entire actuation unit 40 about shoulder socket 46. Only as additional torque is exerted on the actuation unit 40 will the elbow joint 52 break over enabling the user to lower her/his shoulders performing ab crunches under a predetermined resistance.

In utilizing the abdominal exercise machine 20 of the present invention, the individual user will adjust the seat 30, the foot rest 36, leg rest 38, the shoulder harness element 60 and the desired resistance provided by weights 24. He/she will the straddle pad 32 and normally, hook his/her feet under foot rest 36, take hold of handles 66 lowering shoulder harness pads 64 into engagement with his/her shoulders so that the actuation unit 40 travels with his/her torso. This includes enabling crunching movement and rotation of the user's torso about its longitudinal axis to enhance toning of other muscle groups such as oblique and transversalis muscles.

Figure 5:
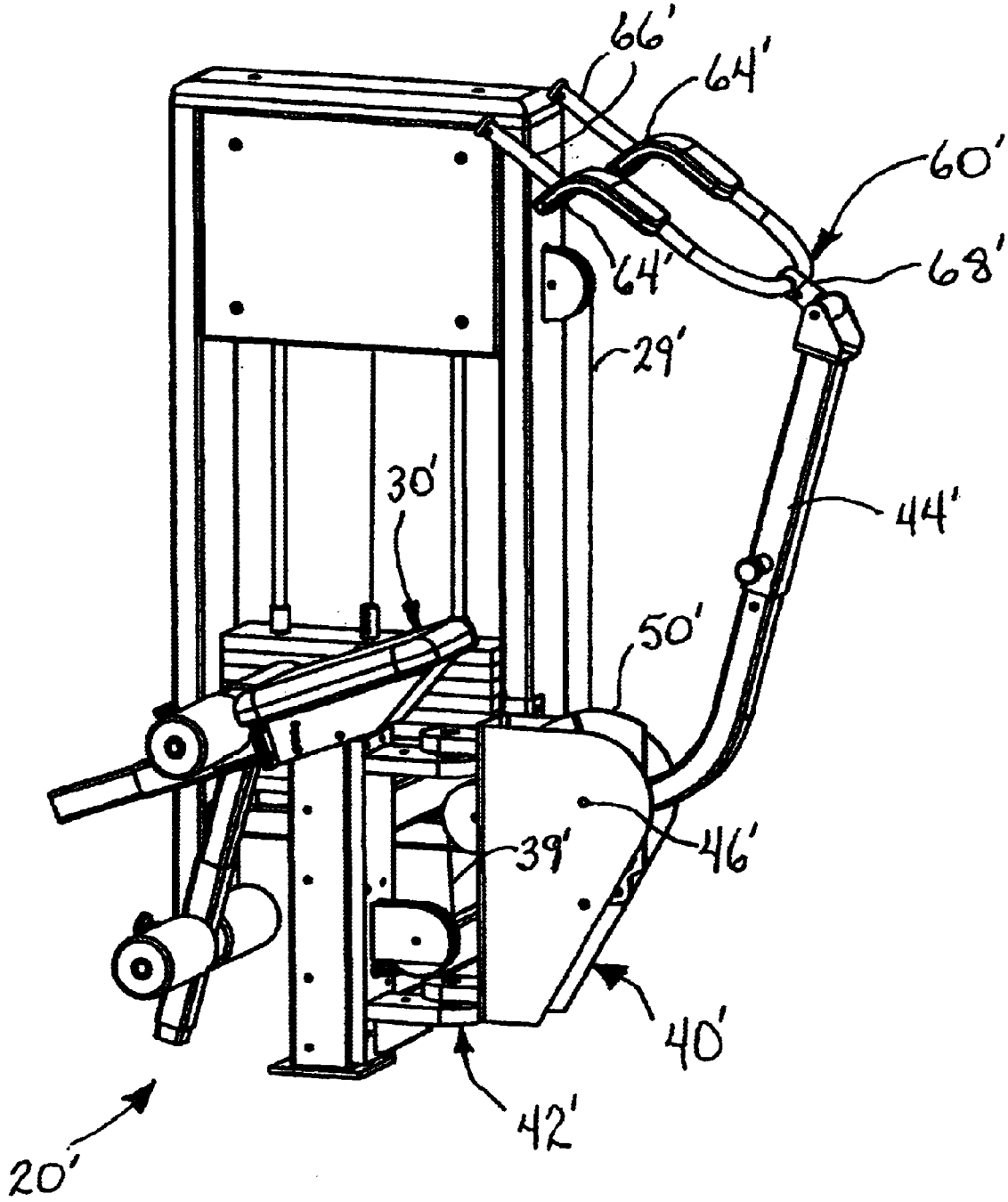
FIG. 5 is a perspective view of a second embodiment of the abdominal exercise machine of the present invention.

FIG. 5 depicts a second embodiment which has many of the same features as the preferred embodiment for a fraction of the cost. In this embodiment, seat 30' and actuation unit 40' are simplified to reduce complexity and, hence, cost of manufacture. The elbow joint has been eliminated and the single arm section 44' (which has length adjustment capability) pivots about a joint 46'. Shoulder harness element 60' is interconnected to the upper end of arm section 44' by the swivel joint 68' like the one used in the first embodiment. Similarly, the second embodiment has a pivot axle 42' permitting lateral twisting to exercise additional muscle groups as discussed in connection with the first embodiment. It is envisioned that this embodiment may be less costly to manufacture and, therefore, more competitive in the low-end home exercise equipment market while the first embodiment will be the "Cadillac" of the ab market and sold to health clubs and high-end users.

The abdominal exercise machine 20 of the present invention provides a machine with enhanced versatility enabling the user 1) to perform a twisting motion which exercises additional muscle groups and 2) to more effectively perform stomach crunches that enhance ab development and toning.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. An abdominal exercise machine comprising a) a resistance unit;

b) a seat for supporting a user, the axis of the user's torso extending generally vertically upward from said seat in an at rest position;

b) an actuation unit positioned adjacent to said seat and pivotally connected thereto so that said actuation unit may pivot about an axis of rotation immediately adjacent to and generally parallel to the axis of the user's torso;

d) a cable interconnecting said resistance unit to said actuation unit, said cable having a cable length extending along said axis of rotation to facilitate pivoting of said actuation unit relative to said seat;

whereby the user can manipulate said actuation unit in a twisting motion to exercise muscle groups including oblique and transversalis muscles.

2. The abdominal exercise machine of claim 1 wherein said actuation unit is pivotally connected to said seat by a pivot axle, said pivot axle rotating about a vertically extending axis.

3. The abdominal exercise machine of claim 2 wherein said pivot axle comprises a first upper bearing member and a second lower bearing member aligned with said first bearing member permitting rotation about said vertically extending axis.

4. The abdominal exercise machine of claim 1 wherein said actuation unit further comprises an actuator arm extending upwardly and a shoulder harness element extending laterally outwardly from said actuator arm over said seat.

5. The abdominal exercise machine of claim 4 wherein said shoulder harness element is connected to said actuator arm by a bearing which permits relative rotational movement to facilitate side crunches in each lateral direction.

6. An abdominal exercise machine comprising a) a resistance unit;

b) a seat for supporting a user, an axis of the user's torso extending generally vertically upward from said seat in an at rest position;

c) an actuation unit connected to said seat, said actuation unit including i) a base portion;

ii) a first arm section pivotally connected to said base portion by means of a shoulder socket, said first arm having a first pivot-resisting element providing a first level of resistance to pivoting of said first arm relative to said base portion;

iii) a second arm section pivotally connected to said first arm section by means of an elbow joint, said second arm having a second pivot-resisting element providing a second level of resistance to pivoting of said second arm relative to said first arm, said second level of resistance always greater than said first level such that said first arm section pivots relative to said base portion prior to said second arm section relative to said first arm section;

whereby the user can pivot said first arm section relative to said base portion and said second arm portion relative to said first arm portion to simulate abdominal crunches.

7. The abdominal exercise machine of claim 6 wherein said first and second pivot-resisting element comprise first and second cams about which a cable interconnecting said resistance unit and said actuation unit passes, said first and second cams having different diameters.

8. The abdominal exercise machine of claim 6 wherein said second arm section includes a shoulder harness element rotationally connected to a main portion of said second arm section permitting one shoulder to be dipped relative to the other to facilitate side crunching exercises.

9. An abdominal exercise machine comprising a) a resistance unit;

b) a seat for supporting a user, the axis of the user's torso extending generally vertically upward from said seat in an at rest position;

d) an actuation unit positioned adjacent to said seat and pivotally connected thereto so that said actuation unit may pivot about an axis of rotation immediately adjacent to and generally parallel to the axis of the user's torso, said actuation unit further comprising i) a base portion;

ii) a first arm section pivotally connected to said base portion;

iii) a second arm section pivotally connected to said first arm section;

d) a cable interconnecting said resistance unit to said actuation unit, said cable having a cable length extending along said axis of rotation to facilitate pivoting of said actuation unit relative to said seat; and, whereby the user can manipulate said actuation unit in a twisting motion to exercise muscle groups including oblique and transversalis muscles and can pivot said first arm section relative to said base portion and said second arm portion relative to said first arm portion to simulate abdominal crunches.

* * * * *